US012213593B2

(12) United States Patent
Wang et al.

(10) Patent No.: US 12,213,593 B2
(45) **Date of Patent: *Feb. 4, 2025**

(54) ADJUSTABLE BED INTEGRATED WITH HEADBOARD AND FRAMES

(71) Applicant: Nisco Co., Ltd, Jiangsu (CN)

(72) Inventors: Wei Wang, Jiangsu (CN); Jian Xie, Jiangsu (CN); Yifan Mao, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 870 days.

This patent is subject to a terminal disclaimer.

(21) Appl. No.: 17/315,751

(22) Filed: May 10, 2021

(65) Prior Publication Data

US 2021/0259431 A1 Aug. 26, 2021

Related U.S. Application Data

(63) Continuation-in-part of application No. 16/867,674, filed on May 6, 2020, now Pat. No. 11,330,911.

(60) Provisional application No. 63/028,035, filed on May 21, 2020, provisional application No. 62/962,324, filed on Jan. 17, 2020, provisional application No. 62/947,561, filed on Dec. 13, 2019.

(51) Int. Cl.
*A47C 20/04* (2006.01)
*A47C 21/00* (2006.01)

(52) U.S. Cl.
CPC ..... *A47C 20/041* (2013.01); *A47C 21/006* (2013.01)

(58) Field of Classification Search
None
See application file for complete search history.

(56) References Cited

U.S. PATENT DOCUMENTS

| | | | | |
|---|---|---|---|---|
| 6,209,157 | B1 * | 4/2001 | Hensley | A47C 20/041 5/613 |
| 11,330,911 | B2 * | 5/2022 | Wang | A47C 20/041 |
| 2017/0360212 | A1 * | 12/2017 | Rawls-Meehan | A47C 27/14 |
| 2021/0007502 | A1 * | 1/2021 | Zeng | A47C 21/006 |

FOREIGN PATENT DOCUMENTS

| | | | | |
|---|---|---|---|---|
| DE | 102015122605 | A1 * | 6/2017 | A47C 19/005 |

* cited by examiner

*Primary Examiner* — Adam C Ortiz
(74) *Attorney, Agent, or Firm* — Locke Lord LLP; Tim Tingkang Xia, Esq.

(57) ABSTRACT

In one aspect of the invention, the adjustable bed includes a headboard assembly having a headboard and an upper rail attached to the headboard; a footboard assembly having a footboard and a lower rail attached to the footboard; a pair of sideboard assemblies having a pair of sideboards and a pair of side rails respectively attached to the pair of sideboards, wherein the pair of sideboard assemblies is transversely spaced and longitudinally aligned in parallel, and detachably attached to the headboard assembly and the footboard assembly; and a lifting mechanism attached to the side rails of the pair of sideboard assemblies for operably adjusting the adjustable bed at a desired position.

13 Claims, 9 Drawing Sheets

ADJUSTABLE BED INTEGRATED WITH HEADBOARD AND FRAMES

CROSS-REFERENCE TO RELATED PATENT APPLICATIONS

This application claims priority to and the benefit of U.S. Provisional Patent Application Ser. No. 63/028,035, filed May 21, 2020, which is incorporated herein in its entirety by reference.

This application is also a continuation-in-part application of U.S. patent application Ser. No. 16/867,674, filed May 6, 2020, now U.S. Pat. No. 11,330,911, which itself claims priority to and the benefit of U.S. Provisional Patent Application Ser. Nos. 62/947,561 and 62/962,324, filed Dec. 13, 2019 and Jan. 17, 2020, respectively, which are incorporated herein in their entireties by reference.

FIELD OF THE INVENTION

The invention generally relates to a bed, and more particular to an adjustable bed integrated with headboard and frames.

BACKGROUND OF THE INVENTION

Sleep is critical for people in every aspect of their lives. Beds are necessary furniture for people to sleep on. A conventional bed usually has a fixed size, such as a king size, a queen size or a full size, which cannot be changed, without body positions adjustable, and also requires professionals to install. Thus, it is beneficial and desirable for people to have a bed system that is capable of adjusting body positions based on user's sleep preference so that the user achieves maximum comfort during sleep. In addition, it is also beneficial and desirable that the bed system can be easily assembled to improve assembly efficiency and increase the user's assembly experience. It is further beneficial and desirable that the size of the bed system can be changeable from one size to another size.

SUMMARY OF THE INVENTION

In one aspect, the invention relates to an adjustable bed integrated with headboard and frames.

In one embodiment, the adjustable bed includes a frame structure having an upper rail, a lower rail, and a pair of side rails attached to the upper rail and the lower rail; a plurality of platforms disposed on the frame structure; a lifting mechanism positioned between the frame structure and the plurality of platforms for operably adjusting positions of at least one of the plurality of platforms so as to adjust the adjustable bed at a desired position; and a headboard, a footboard, and a pair of sideboards attached to outer sides of the upper rail, the lower rail, and the pair of side rails, respectively, of the frame structure.

In one embodiment, the lifting mechanism comprises a pair of lifting assemblies. Each lifting assembly comprises a bracket mounted on the frame structure a back lifting arm and a leg lifting mechanism; and a back lifting actuator and a leg lifting actuator received in the bracket, wherein each of the back and leg lifting actuators comprises a driving shaft and a motor member engaged with the driving shaft for driving the driving shaft to rotate. The driving shaft of the back lifting actuator is engaged with the back lifting arm for operably adjusting the back lifting arm at desired back positions. The driving shaft of the leg lifting actuator is engaged to the leg lifting mechanism for operably adjusting the leg lifting mechanism at desired leg positions.

In one embodiment, the leg lifting mechanism comprises first, second, and third leg supporting members, wherein the first leg supporting member is connected to the driving shaft of the leg lifting actuator, the second leg supporting member is pivotally connected to the first leg supporting member, the third leg supporting member is pivotally connected to the second leg supporting member and the frame structure.

In one embodiment, the lifting mechanism comprises a back lifting assembly and a leg lifting assembly. The back lifting assembly comprises a back lifting bracket pivotally connected to the frame structure, and a back lifting actuator pivotally connected between the back lifting bracket and the frame structure for operably driving the back lifting bracket to pivotally move in an upward rotating direction or a downward rotating direction relative to the frame structure. The leg lifting assembly comprises a leg lifting bracket pivotally connected to the frame structure, and a leg lifting actuator pivotally connected between the leg lifting bracket and the frame structure for operably driving the leg lifting bracket to pivotally move in an upward rotating direction or a downward rotating direction relative to the frame structure.

In one embodiment, the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the frame structure and the second end portion of the activation rod pivotally connected to the back lifting bracket, or wherein the motor member is pivotally connected to the back lifting bracket and the second end portion of the activation rod pivotally connected to the frame structure.

In one embodiment, the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the frame structure and the second end portion of the activation rod pivotally connected to the leg lifting bracket, or wherein the motor member is pivotally connected to the leg lifting bracket and the second end portion of the activation rod pivotally connected to the frame structure.

In one embodiment, the plurality of platforms comprises at least one back platform, a thigh platform and a leg platform coupled to the lifting mechanism. As such, the at least one back platform is operably rotatable around its lower edge in a back platform downward rotating direction or a back platform upward rotating direction; and the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

In one embodiment, the adjustable bed further comprises the one or more massage devices installed on the plurality of platforms for operably providing massage effects.

In one embodiment, the one or more massage devices comprise sonic vibrators, and/or motor driven massagers.

In one embodiment, the adjustable bed further comprises the one or more breathing members installed on the plurality of platforms.

In one embodiment, the upper rail and the lower rail are longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length that is adjustable or fixed and defines a size of the adjustable bed.

In another aspect of the invention, the adjustable bed comprises a headboard assembly having a headboard and an upper rail attached to the headboard; a footboard assembly having a footboard and a lower rail attached to the footboard; a pair of sideboard assemblies having a pair of sideboards and a pair of side rails respectively attached to the pair of sideboards, wherein the pair of sideboard assemblies is transversely spaced and longitudinally aligned in parallel, and detachably attached to the headboard assembly and the footboard assembly; and a lifting mechanism attached to the side rails of the pair of sideboard assemblies for operably adjusting the adjustable bed at a desired position.

In one embodiment, the lifting mechanism comprises a pair of lifting assemblies, wherein each lifting assembly comprises a bracket attached to a respective side rail of the pair of side rails; a back lifting arm and a leg lifting mechanism; and a back lifting actuator and a leg lifting actuator received in the bracket, wherein each of the back and leg lifting actuators comprises a driving shaft and a motor member engaged with the driving shaft for driving the driving shaft to rotate, wherein the driving shaft of the back lifting actuator is engaged with the back lifting arm for operably adjusting the back lifting arm at desired back positions, and wherein the driving shaft of the leg lifting actuator is engaged to the leg lifting mechanism for operably adjusting the leg lifting mechanism at desired leg positions.

In one embodiment, the leg lifting mechanism comprises first, second, and third leg supporting members, wherein the first leg supporting member is connected to the driving shaft of the leg lifting actuator, the second leg supporting member is pivotally connected to the first leg supporting member, the third leg supporting member is pivotally connected to the second leg supporting member and the respective side rail.

In one embodiment, the lifting mechanism comprises a back lifting assembly and a leg lifting assembly, wherein the back lifting assembly comprises a back lifting bracket pivotally connected to the pair of side rails, and a back lifting actuator pivotally connected between the back lifting bracket and the pair of side rails for operably driving the back lifting bracket to pivotally move in an upward rotating direction or a downward rotating direction relative to the pair of side rails; and wherein the leg lifting assembly comprises a leg lifting bracket pivotally connected to the pair of side rails, and a leg lifting actuator pivotally connected between the leg lifting bracket and the pair of side rails for operably driving the leg lifting bracket to pivotally move in an upward rotating direction or a downward rotating direction relative to the pair of side rails.

In one embodiment, the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation.

In one embodiment, the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation.

In one embodiment, the adjustable bed further comprises a plurality of platforms having at least one back platform, a thigh platform and a leg platform coupled to the lifting mechanism, such that the at least one back platform is operably rotatable around its lower edge in a back platform downward rotating direction or a back platform upward rotating direction; and the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

In one embodiment, the adjustable bed also has the one or more massage devices installed on the plurality of platforms for operably providing massage effects.

In one embodiment, the one or more massage devices comprise sonic vibrators, and/or motor driven massagers.

In one embodiment, the adjustable bed further comprises the one or more breathing members installed on the plurality of platforms.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
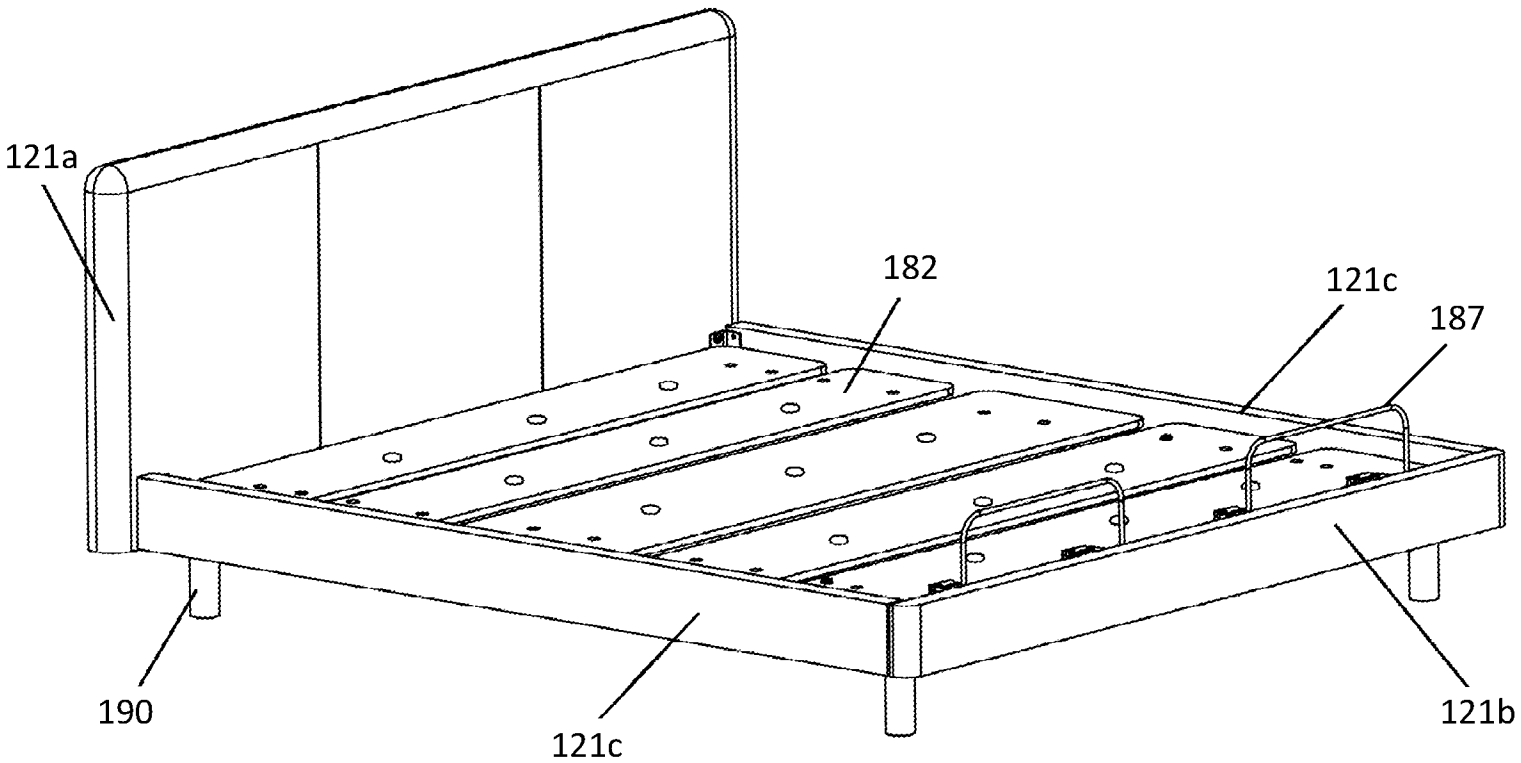
FIG. 1 shows schematically a perspective view of an adjustable bed in a flat/plane state according to embodiments of the invention.
Figure 2:
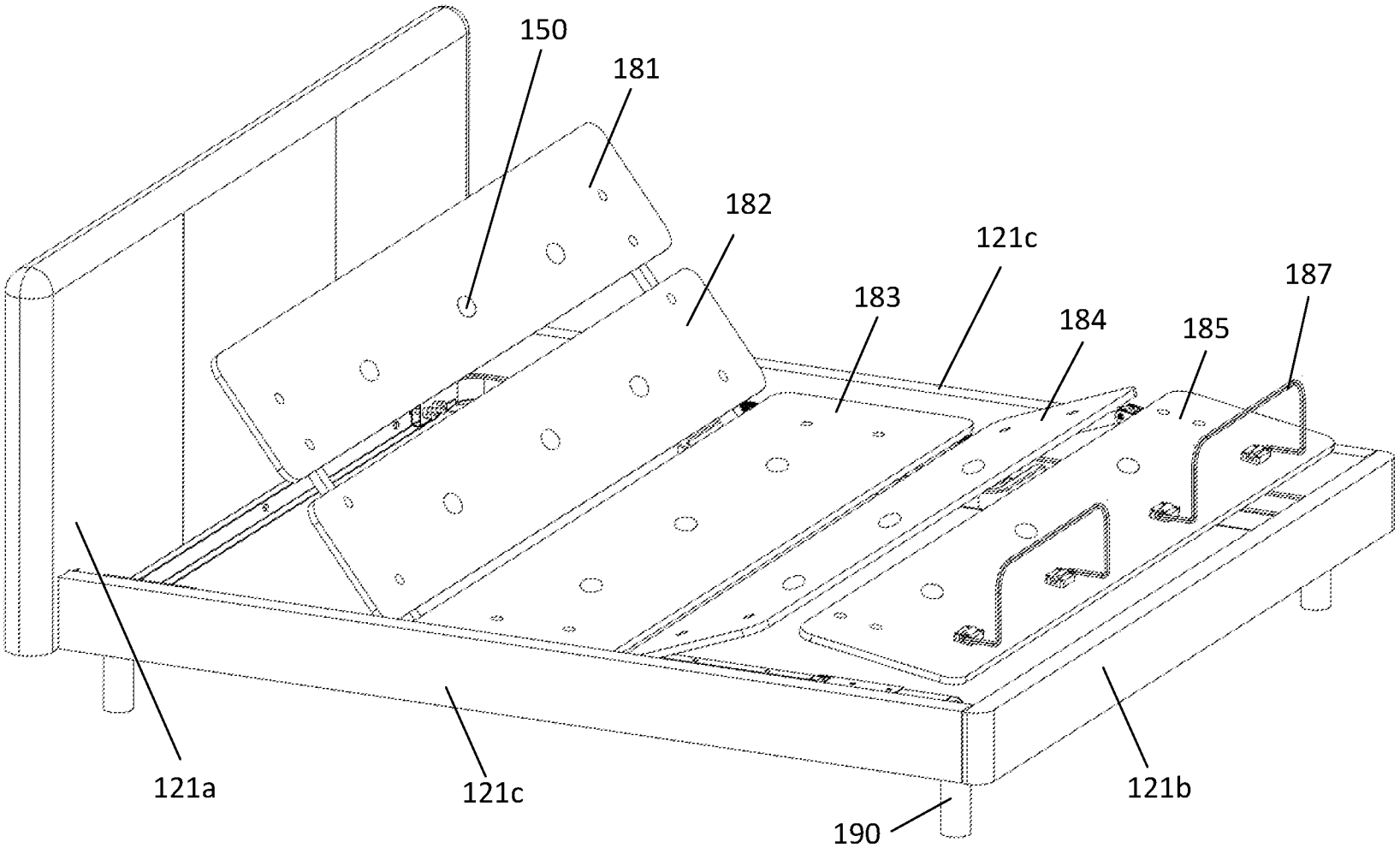
FIG. 2 shows schematically a perspective view of an adjustable bed in a lift/adjusted state according to embodiments of the invention.
Figure 3:
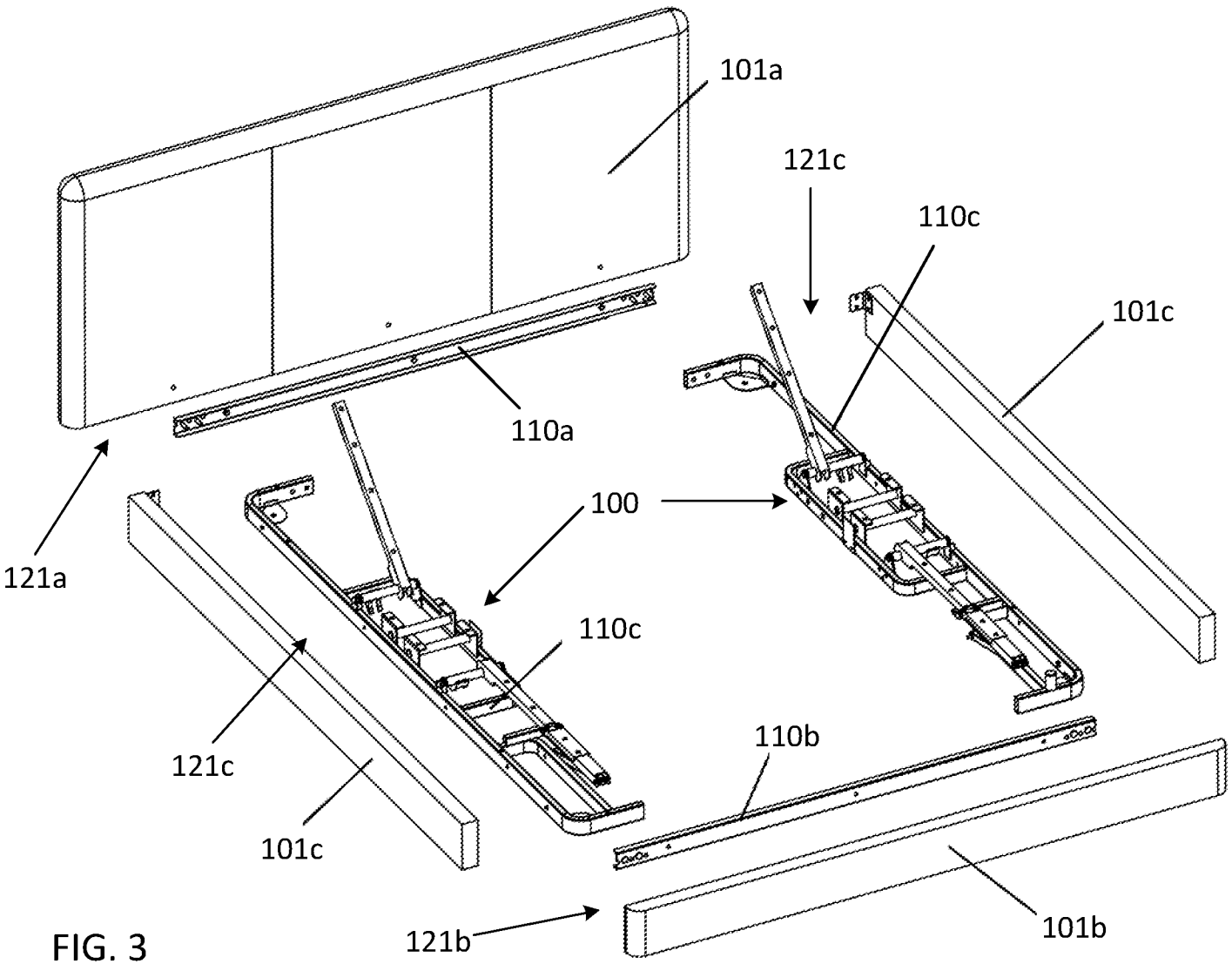
FIG. 3 shows schematically an exploded view of an adjustable bed according to embodiments of the invention.
Figure 4:
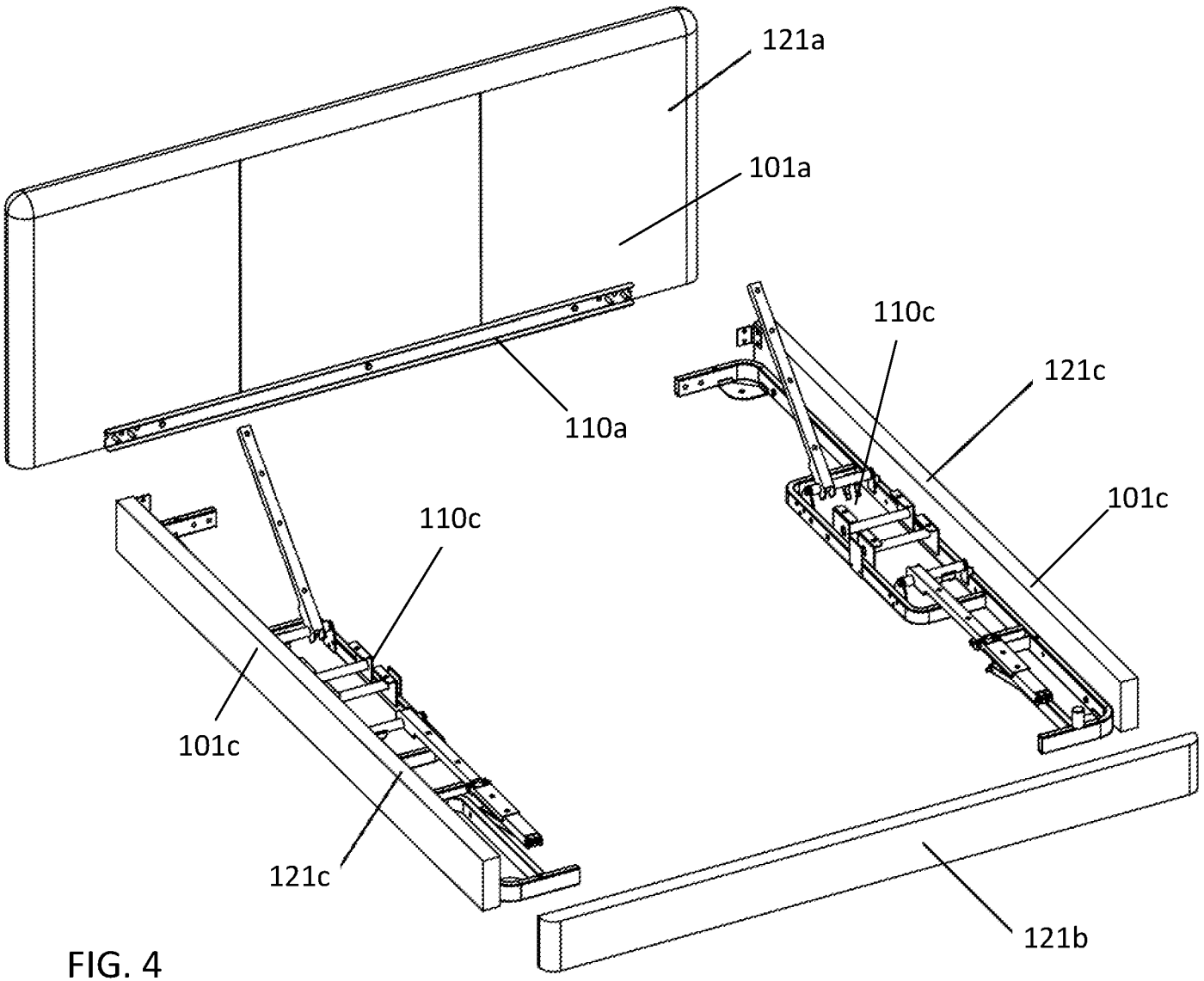
FIG. 4 shows schematically an exploded view of an adjustable bed according to embodiments of the invention.
Figure 5:
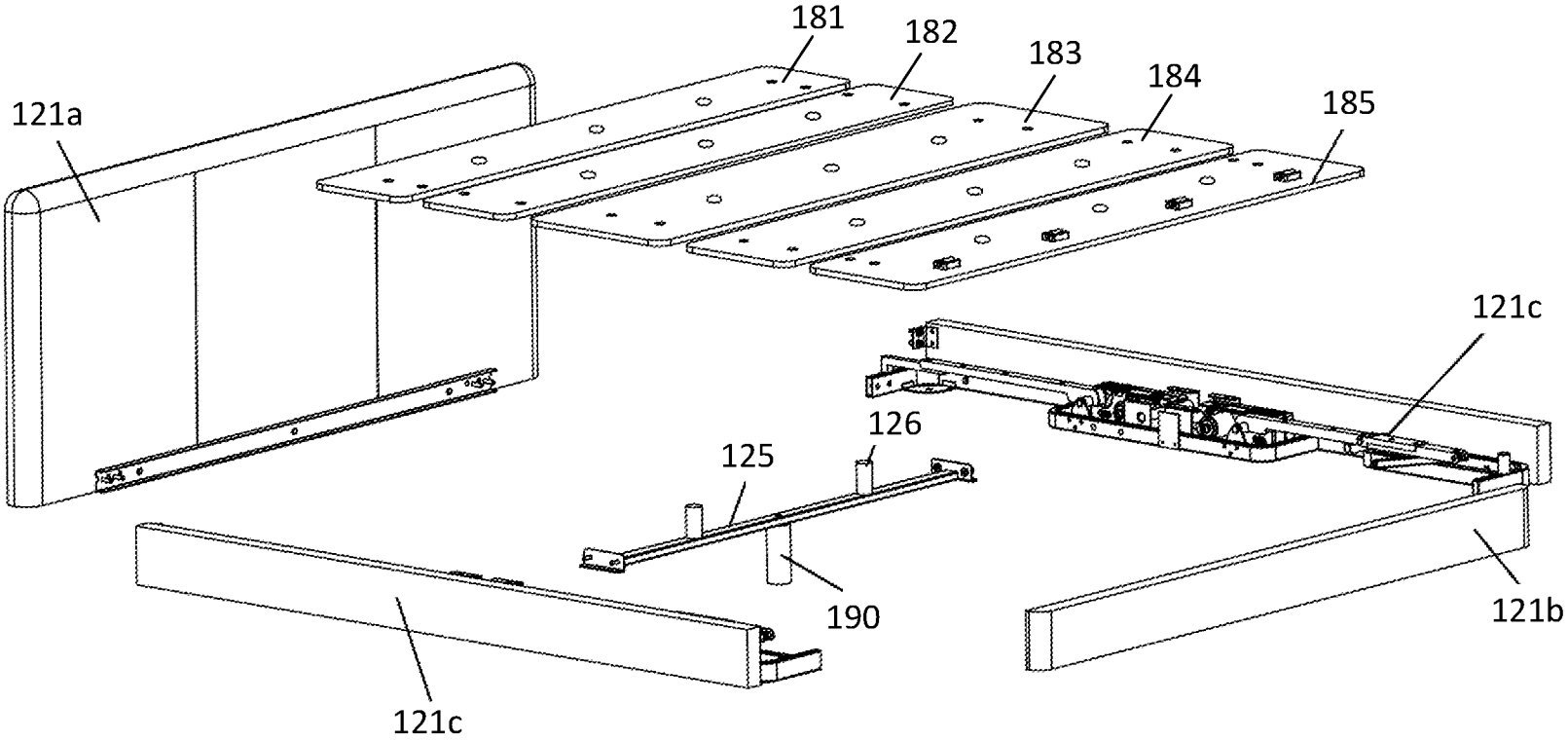
FIG. 5 shows schematically an exploded view of an adjustable bed according to embodiments of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the term "platform" refers to a bed board.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

In accordance with the purposes of this invention, as embodied and broadly described herein, this invention, in one aspect, relates to an adjustable bed integrated with headboard and frames.

In one aspect of the invention, the adjustable bed includes a headboard assembly having a headboard and an upper rail attached to the headboard; a footboard assembly having a footboard and a lower rail attached to the footboard; a pair of sideboard assemblies having a pair of sideboards and a pair of side rails respectively attached to the pair of sideboards, wherein the pair of sideboard assemblies is transversely spaced and longitudinally aligned in parallel, and detachably attached to the headboard assembly and the footboard assembly; and a lifting mechanism attached to the side rails of the pair of sideboard assemblies for operably adjusting the adjustable bed at a desired position.

In another aspect of the invention, the adjustable bed includes a frame structure having an upper rail, a lower rail, and a pair of side rails attached to the upper rail and the lower rail; a plurality of platforms disposed on the frame structure; a lifting mechanism positioned between the frame structure and the plurality of platforms for operably adjusting positions of at least one of the plurality of platforms so as to adjust the adjustable bed at a desired position; and a headboard, a footboard, and a pair of sideboards attached to outer sides of the upper rail, the lower rail, and the pair of side rails, respectively, of the frame structure.

In some embodiments, the lifting mechanism comprises a pair of lifting assemblies. Each lifting assembly comprises a bracket mounted on the frame structure a back lifting arm and a leg lifting mechanism; and a back lifting actuator and a leg lifting actuator received in the bracket, wherein each of the back and leg lifting actuators comprises a driving shaft and a motor member engaged with the driving shaft for driving the driving shaft to rotate. The driving shaft of the back lifting actuator is engaged with the back lifting arm for operably adjusting the back lifting arm at desired back positions. The driving shaft of the leg lifting actuator is engaged to the leg lifting mechanism for operably adjusting the leg lifting mechanism at desired leg positions.

In some embodiments, the leg lifting mechanism comprises first, second, and third leg supporting members. The first leg supporting member is connected to the driving shaft of the leg lifting actuator, the second leg supporting member is pivotally connected to the first leg supporting member, the third leg supporting member is pivotally connected to the second leg supporting member and the frame structure.

In some embodiments, the lifting mechanism comprises a back lifting assembly and a leg lifting assembly. The back lifting assembly comprises a back lifting bracket pivotally connected to the frame structure, and a back lifting actuator pivotally connected between the back lifting bracket and the frame structure for operably driving the back lifting bracket to pivotally move in an upward rotating direction or a downward rotating direction relative to the frame structure. The leg lifting assembly comprises a leg lifting bracket pivotally connected to the frame structure, and a leg lifting actuator pivotally connected between the leg lifting bracket and the frame structure for operably driving the leg lifting bracket to pivotally move in an upward rotating direction or a downward rotating direction relative to the frame structure.

In some embodiments, the back lifting actuator comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation. In one embodiment, the motor member is pivotally connected to the frame structure and the second end portion of the activation rod pivotally connected to the back lifting bracket. In another embodiment, the motor member is pivotally connected to the back lifting bracket and the second end portion of the activation rod pivotally connected to the frame structure.

In some embodiments, the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation. In one embodiment, the motor member is pivotally connected to the frame structure and the second end portion of the activation rod pivotally connected to the leg lifting bracket. In another embodiment, the motor member is pivotally connected to the leg lifting bracket and the second end portion of the activation rod pivotally connected to the frame structure.

In some embodiments, the plurality of platforms comprises at least one back platform, a thigh platform and a leg platform coupled to the lifting mechanism. As such, the at least one back platform is operably rotatable around its lower edge in a back platform downward rotating direction or a back platform upward rotating direction; and the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

In some embodiments, the adjustable bed further comprises the one or more massage devices installed on the plurality of platforms for operably providing massage effects.

In some embodiments, the one or more massage devices comprise sonic vibrators, and/or motor driven massagers.

In one embodiment, the adjustable bed further comprises the one or more breathing members installed on the plurality of platforms.

In some embodiments, the upper rail and the lower rail are longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length that is adjustable or fixed and defines a size of the adjustable bed.

The exemplary embodiments of the adjustable bed are described in detail in conjunction with the accompanying drawings in FIGS. 1-11.

Referring to FIGS. 1-5, the adjustable bed is shown according to one embodiment of the invention. In the exemplary embodiment, the adjustable bed includes a headboard assembly 121*a*, a footboard assembly 121*b*, and a pair of sideboard assemblies 121*c* that is transversely spaced and longitudinally aligned in parallel, and detachably attached to the headboard assembly 121*a* and the footboard assembly 121*b*.

The headboard assembly 121*a* includes a headboard (head panel) 101*a* and an upper rail (bar) 110*a* attached to the lower portion of the headboard 101*a*. In some embodiments, the upper rail 110*a* is a rigid rail or alloy (e.g., steel, aluminum, etc.) rail secured to the lower portion of the headboard 101*a* by screws, glue, or any other securing means. In the exemplary embodiment shown in FIGS. 3-5, the upper rail 110*a* is a C-shape steel bar.

The footboard assembly 121*b* includes a footboard (foot panel) 101*b* and a lower rail (bar) 110*b* attached to the footboard 101*b*. In some embodiments, the upper rail 110*a* is a rigid rail or alloy (e.g., steel, aluminum, etc.) rail secured to the footboard 101*b* by screws, glue, or any other securing means. In the exemplary embodiment shown in FIGS. 3-5, the upper rail 110*a* is a C-shape steel bar.

The pair of sideboard assemblies 121*c* includes a pair of sideboards (side panel) 101*c* and a pair of side rails (bars) 110*c* respectively attached to the pair of sideboards 101*c*. In some embodiments, the pair of side rails 110*c* is a pair of rigid rails or alloy (e.g., steel, aluminum, etc.) rails secured to the pair of sideboard assemblies 121*c* by screws, glue, or any other securing means.

Figure 6:
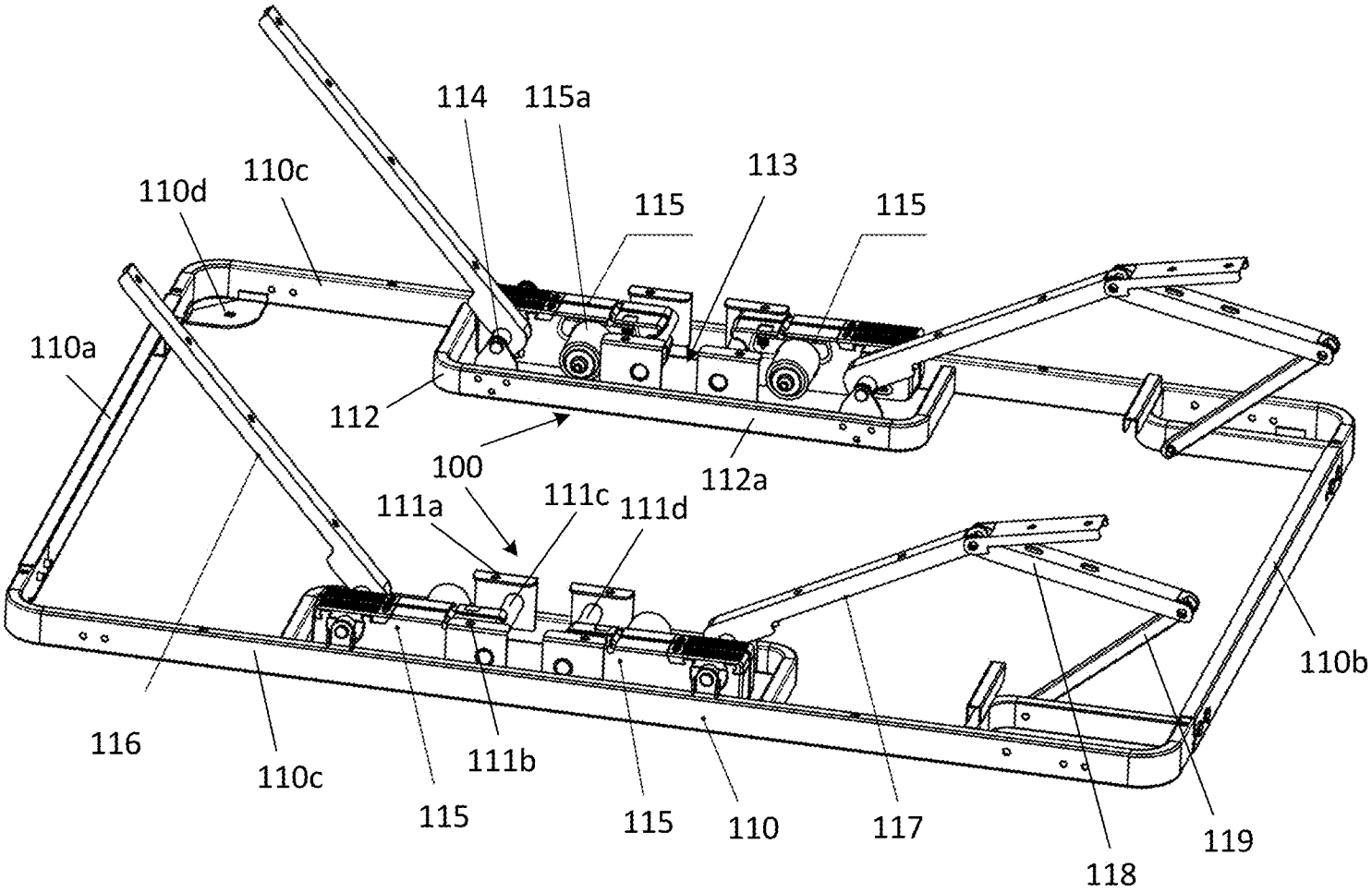
FIG. 6 shows schematically a perspective view of a lifting mechanism and a frame structure of an adjustable bed according to embodiments of the invention.

Two ends of the upper rail 110*a* are detachably connected to the upper end potions of the pair of side rails 110*c* and two ends of the lower rail 110*b* are detachably connected to the lower end portions of the pair of side rails 110*c* such that the upper rail 110*a* and the lower rail 110*b* are parallel to each other, and the upper rail 110*a* and the lower rail 110*b* and the pair of side rails 110*c* are co-planar in a rectangle form, as shown in FIG. 6 for example. These connections can be screw-type connections, plug-type connections, or any other connection means. In the embodiment, each of the upper and lower end portions has a reinforcing flange 110*d*. In other embodiments, the reinforcing flange 110*d* can be replaced a reinforcing bar or other reinforcing means, e.g., reinforcing bars.

In addition, each of the upper rail 110*a* and the lower rail 110*b* has a length that is adjustable or fixed and defines a size of the bed. For example, if a user wants to convert the bed system from one size to another size, e.g., from a queen size to a king size, the user only needs to adjust the length of the upper rail 110*a* and the lower rail 110*b* to fit the king size, or replace the queen size upper rail 110*a* and lower rail 110*b* with the king size upper rail 110*a* and lower rail 110*b*.

As shown in FIGS. 1-2, 5 and 7, the adjustable bed also has a plurality of platforms (or bed boards) 181-185 disposed on the frame structure 110 including the upper rail 110*a*, the lower rail 110*b*, and the pair of side rails 110*c*. The plurality of platforms includes a head platform/board 181, a back platform/board 182, a seat or waist platform/board 183, a thigh platform/board 184, a leg platform/board 185, orderly disposed on the pair of side rails 110*c* along the direction from the upper rails 110*a* to the lower rails 110*b*. The waist board 4 is fixed on the side rails 110*c*, while the head board 181, the back platform 182, the thigh platform 184 and the leg platform 185 are movably disposed on the the pair of side rails 110*c*, such that at least one of the plurality of platforms 181-185 is adjustable so as to adjust the bed at a desired position. Further, a pair of baffles 187 are also attached to the leg platform 185. The design of the baffles 187 can limit the position of the mattress when placed on the bed platforms so as to prevent the mattress from sliding on the bed platforms.

A number of bed legs/posts 190 are installed at the bottom of the frame structure 110 to support the frame structure 110. The bed legs 190 in some embodiments are mounted on the frame structure 110 by bolts or screws.

As shown in FIGS. 3-8, the adjustable bed also includes a lifting mechanism attached to the side rails of the pair of sideboard assemblies for operably adjusting the adjustable bed at a desired position.

Figure 7:
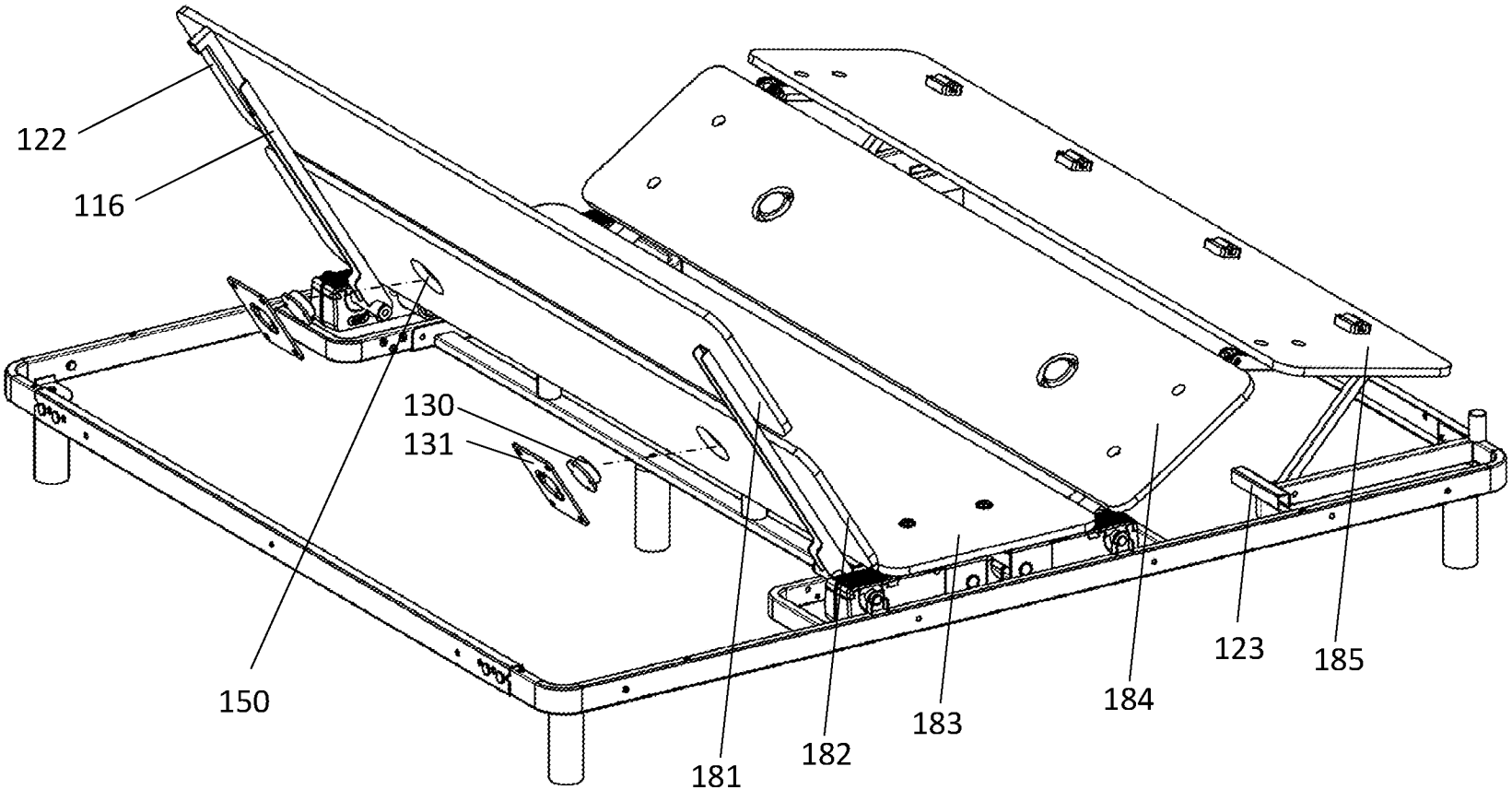
FIG. 7 shows schematically a perspective view of a lifting mechanism, a frame structure and platforms of the adjustable bed shown in FIG. 6.

Referring to FIGS. 6-7, for example, the lifting mechanism comprises a pair of lifting assemblies 100 with each mounted on the respective side rail 110*c* of the frame structure 110. The pair of lifting assemblies 100 operates cooperatively to adjust the plurality of platforms 181-185 at the desired positions. Each lifting assembly 100 comprises a bracket 112 mounted on the frame structure 110 and located below the waist board 183. The bracket 112 is a U-shaped bracket amounted on one side rails 110*c* of the frame structure 110 to form an installation space 113 for a respective lifting assembly 100. In one embodiment, the bracket 112 comprises a base member 112*a* attached to a respective one of the pair of side rails 110*c*, a pair of tab members 111*a* and 111*b* vertically attached to the base member 112*a*, and a pair of bars 111*c* and 111*d* transversely attached to top portions of the pair of tab members 111*a* and 111*b*, as shown in FIG. 6. Each tab member 111*a*/111*b* comprises a single tab, two tabs, or more taps.

Each lifting assembly 100 also includes a back lifting arm 116 and a leg lifting mechanism; and a pair of lifting actuators (a back lifting actuator and a leg lifting actuator) 115 received in and secured on the bracket 112. Each of the back and leg lifting actuators 115 comprises a driving shaft 114 hinged with s side rail 110*c* of the frame structure 110 and the bracket 112 and a motor member 115*a* engaged with the driving shaft 114 for driving the driving shaft 114 to rotate. The driving shaft 114 of the back lifting actuator 115 is engaged with the back lifting arm 116 for operably adjusting the back lifting arm 116 at desired back positions. The driving shaft 114 of the leg lifting actuator 115 is engaged to the leg lifting mechanism for operably adjusting the leg lifting mechanism at desired leg positions.

According to embodiments of the invention, the head and back platforms 181-182 are coupled with the back lifting arm 116 such that the head and back platforms 181-182 are operably rotatable around its lower edge in a back platform downward rotating direction or a back platform upward rotating direction. Specifically, the back lifting arm 116 is engaged with to the driving shaft 114 of the back lifting actuator 115 and extends below the head platform 181. The head platform 181 and the back platform 182 are both fixed on the back lifting arm 116, and the back lifting arm 116 drives the head platform 181 and the back platform 182 to turn at a desired position at the same time.

The leg lifting mechanism comprises first, second, and third leg supporting members 117, 118 and 119. The first leg supporting member 117 is connected to the driving shaft 114 of the leg lifting actuator 115, the second leg supporting member 118 is pivotally connected to the first leg supporting member 117, and the third supporting member 119 is pivotally connected to the second leg supporting member 118 and the frame structure 110. According to embodiments of the invention, the thigh platform 184 and the leg platform 185 are coupled to the leg lifting mechanism, such that the thigh platform 185 is rotatable around its upper edge in a thigh platform downward rotating direction or a thigh platform upward rotating direction, and the leg platform 185 is rotatable around its upper edge in a leg platform downward rotating direction or a leg platform upward rotating direction. Specifically, the first leg supporting member 117 extends below the thigh platform 184 and is connected to the rotating rod 114 at one end. The thigh platform 184 is fixed on the first leg supporting member 117. As such, the first leg supporting member 117 operably drives the thigh platform 184 to turn at a desired position. At the bottom of the leg platform 185, the second leg supporting member 118 corresponding to the first leg supporting member 117 is also installed. Specifically, one end of the second leg supporting member 118 is hinged with another end of the first leg supporting member 117, another end of the second leg supporting member 118 is hinged with the third leg supporting member 119, which in turn is hinged to the frame structure 110. When the second leg supporting member 118 is in a horizontal state, the second leg supporting member 118, the third leg supporting member 119, and the frame structure 110 are in form of in a zigzag shape.

In addition, a positioning rod/bar 122 (see FIGS. 3 and 6) corresponding to the back lifting arm 116 is attached to the back lifting arm 116 and adapted such that when the bed is in a laid back position (i.e., a horizontal position, or a flat position), the positioning bar 122 in cooperation with the back lifting arm 116 is positioned against the upper rail 110*a* of the frame structure 110 so as to provide further support for the back lifting arm 116. The positioning rod 122 is designed to cooperate with the back lifting arm 116. In one embodiment, the back lifting arm 116 has a channel steel structure or C-shaped steel structure with a downward opening, and the positioning rod 122 has the same structure as the back lifting arm 116. When the back lifting arm 116 is turned to the horizontal state, the position of the back lifting arm 116 is positioned and limited by the positioning rod 122, so as to ensure the back lifting arm 116 is supported the frame structure 110 and to prevent the back lifting arm 116 from turning too low and affecting the user's normal lying down position.

Further, a supporting bar/rod 123 corresponding to the first leg supporting member 117 is also installed on the frame structure 110, as shown in FIG. 6. The supporting rod 123 is horizontally arranged and located below the first leg supporting member 117. The support rod 123 is designed to cooperate with the first leg supporting member 117. When the first leg supporting member 117 is turned to the horizontal state, the first leg supporting member 117 is supported by the supporting rod 123 so as to prevent the first leg supporting member 117 from turning too low, and affecting the user's normal lying down position.

In operations, the rotations of the four driving motors 115 in the two installation spaces 113 drive the four rotating rods 114 to rotate accordingly. The rotations of the rotating rods 114 of the back lifting actuator and the leg lifting actuator 115 in turn drive the two back lifting arms 116 and the two first leg supporting members 117 to rotate/flip upward at the same time, the upward flip of the back lifting arms 116 drives the head platform 181 and the back platform 182 to flip upward at the same time, and the upward flip of the first leg supporting member 117 drives the thigh platform 184 to flip upward. When the first leg supporting member 117 is turned upwards, the hinged sides/ends of the second leg supporting member 118 and the first leg supporting member 117 flip upward at the same time, while the other side of the second leg supporting member 118 flips downward due to the presence of the third leg supporting member 119. As such, the turning of the leg platform 185 with one side up and one side down is realized, thereby completing the turning action of the entire bed platforms. In this case, the bed is in an adjusted position. The oppose operation of the four driving motors 115 will position all the platforms in a horizontal state, and the bed is in the laid back position.

Figure 8:
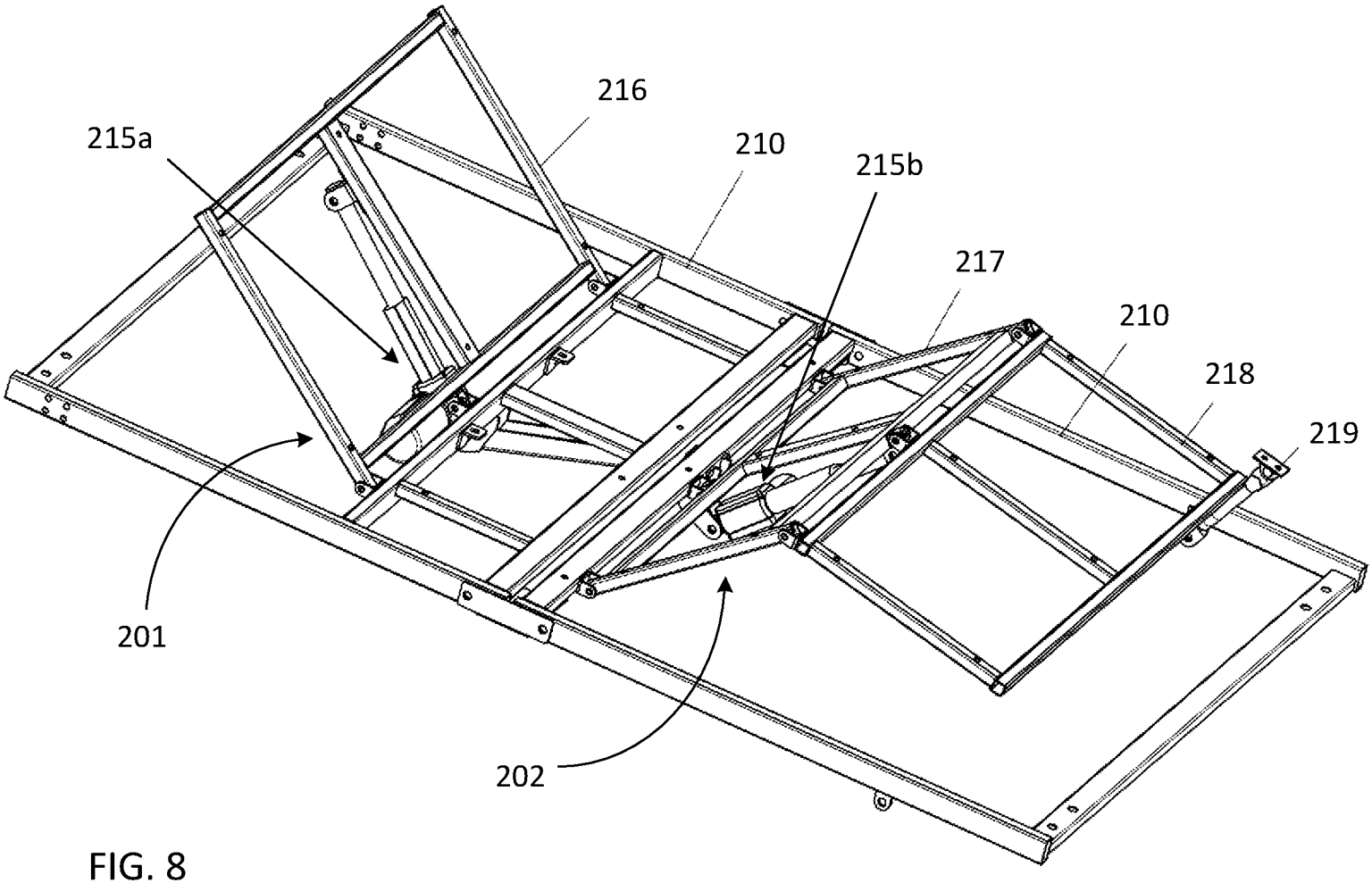
FIG. 8 shows schematically a perspective view of a lifting mechanism and a frame structure of an adjustable bed according to embodiments of the invention.

It should be appreciated that other types of the lifting mechanism can also be used in practice the invention. For example, FIG. 8 show another embodiment of the lifting mechanism used for the bed of the invention. In the exemplary embodiment, the lifting mechanism comprises a back lifting assembly 201 and a leg lifting assembly 202.

The back lifting assembly 201 comprises a back lifting bracket 216 pivotally connected to the frame structure 210, and a back lifting actuator 215*a* pivotally connected between the back lifting bracket 216 and the frame structure 210 for operably driving the back lifting bracket 216 to pivotally move in an upward rotating direction or a downward rotating direction relative to the frame structure 210, thereby, adjusting the positions of the head and back platforms 281 and 282.

In one embodiment, the back lifting actuator 215*a* comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation. The motor member is pivotally connected to the frame structure 210 and the second end portion of the activation rod pivotally connected to the back lifting bracket. Alternatively, the motor member is pivotally connected to the back lifting bracket and the second end portion of the activation rod pivotally connected to the frame structure 210.

The leg lifting assembly 202 comprises a leg lifting bracket 217 and 218 pivotally connected to the frame structure 210, and a leg lifting actuator 215*b* pivotally connected between the leg lifting bracket 217 and the frame structure 210 for operably driving the leg lifting bracket 217 and 218 to pivotally move in an upward rotating direction or a downward rotating direction relative to the frame structure 210, thereby, adjusting the positions of the thigh and leg platforms 284 and 285. In the embodiment, a supporting rob 219 has one end pivotally connected the frame structure 210 and another end connected to the bottom of the leg platform 285.

In one embodiment, the leg lifting actuator 215*b* comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation. The motor member is pivotally connected to the frame structure and the second end portion of the activation rod pivotally connected to the leg lifting bracket. Alternatively, the motor member is pivotally connected to the leg lifting bracket and the second end portion of the activation rod pivotally connected to the frame structure.

Figure 9:
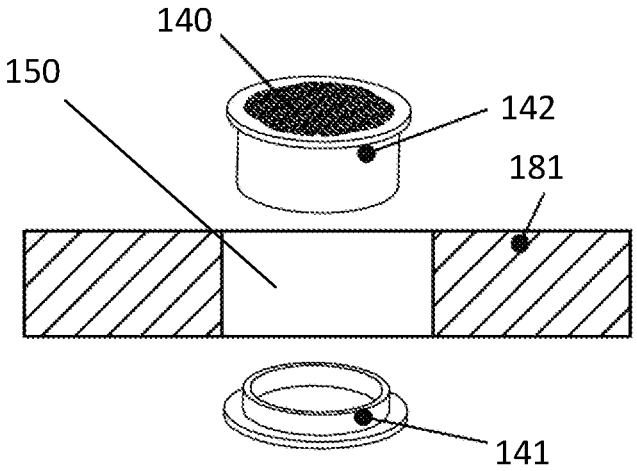
FIG. 9 shows schematically an exploded view of a breathing member of an adjustable bed according to embodiments of the invention.

In some embodiments, the adjustable bed may also include one or more breathing members installed on holes of the plurality of platforms. As shown in FIG. 9, the breathing member 140 has a first member 141 and a second member 142 is mounted to the head platform 181 by connecting the first member 141 and the second member 142 through the hole 150 defined in the head platform 181. In this exemplary embodiment, the second member 142 is adapted for air circulation. Each platform may include one or more breathing members 140.

Additionally, the adjustable bed may further include one or more massage devices installed on the plurality of platforms for operably providing massage effects. In some embodiments, the one or more massage devices comprise sonic vibrators, and/or motor driven massagers.

Figure 10:
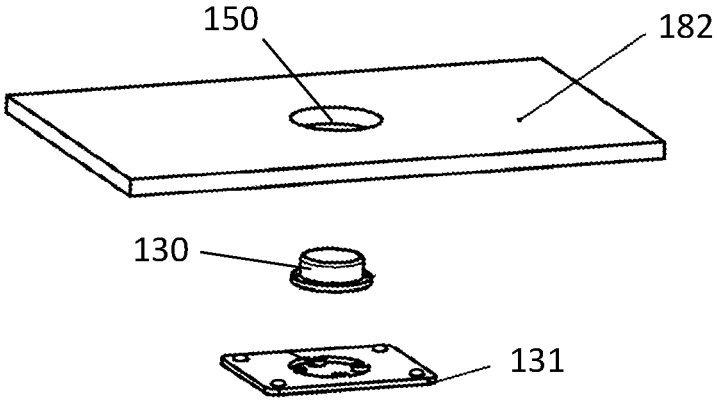
FIG. 10 shows schematically an exploded view of a massage device of an adjustable bed according to embodiments of the invention.

For example, as shown in FIG. 10, the sonic vibrator 130 is accommodated in an opening 150 defined in a respective platform of the plurality of platforms through a transition piece fixed on the respective platform. The sonic vibrator is a music based vibrator capable of being activated by music and sonic wave. In the exemplary embodiment shown in FIG. 7, there are four sonic vibrators 130 in total, of which two music vibrators 130 are installed on the back platform 182, and the other two music vibrators 130 are installed on the thigh platform 184. Such arrangements allows for improving relaxation of the thighs and back of the user. It should be appreciated that other numbers of music vibrators can also be utilized to practice the invention, and the music vibrators can also be installed on the other platforms.

In the embodiments, the transition connection mechanism is used to install the music vibrators 130 on the platforms. The transition connection mechanism includes a transition piece 131 that is attached to the back platform 182 or the thigh platform 184. The back platform 182 and the thigh platform 184 are also provided with through holes 150 for installation of the music vibrators 130 and accommodation of vibrations generated from the music vibrators 130 when activated. The transition piece 131 is fixed on the bottom surface of the back platform 182 or the thigh platform 184 by bolts/screws, and corresponding threaded blind holes are also opened on the bottom surface of the back platform 182 or the thigh platform 184. As shown in such embodiments, the connection between the music vibrator 130 and the transition piece 131 is achieved by opening a through hole corresponding to the music vibrator 130 on the transition piece 131, thereby reducing the contact area between the music vibrator 130 and the transition piece 131 to improve the music vibrator 130. The vibration effect improves the user's comfort.

Figure 11:
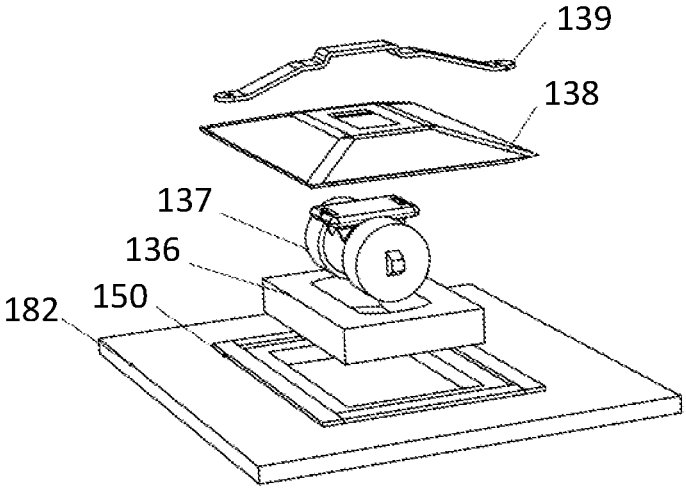
FIG. 11 shows schematically an exploded view of a massage device of an adjustable bed according to embodiments of the invention.

In one exemplary embodiment shown in FIG. 11, the motor driven massager includes a foam house 136 accommodated in an opening 150 of a platform, e.g., back platform 182, a massage motor 137 placed in the foam house 136, a massage motor cover 138 covering the massage motor 137, and an elastic belt 139 securing the motor driven massager on the back platform 182.

The adjustable bed also includes a controller electrically coupled to the back lifting actuators (motors), the leg lifting actuators (motors), the massage devices, so as to lift individually or cooperatively the head and back platforms 181 and 182, the thigh platform 184, and the leg platform 185 in desired positions, and to provide the massage effects to the user.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a frame structure having an upper rail, a lower rail, and a pair of side rails attached to the upper rail and the lower rail;

a plurality of platforms disposed on the frame structure; and a lifting mechanism positioned between the frame structure and the plurality of platforms for operably adjusting positions of at least one of the plurality of platforms so as to adjust the adjustable bed at a desired position; and a headboard, a footboard, and a pair of sideboards attached to outer sides of the upper rail, the lower rail, and the pair of side rails, respectively, of the frame structure, wherein the lifting mechanism comprises a pair of lifting assemblies, wherein each lifting assembly comprises:

a bracket mounted on the frame structure, wherein the bracket comprises a base member attached to a respective one of the pair of side rails, a pair of tab members vertically attached to the base member, and a pair of bars transversely attached to top portions of the pair of tab members;

a back lifting arm and a leg lifting mechanism; and a back lifting actuator and a leg lifting actuator received in the bracket, wherein each of the back and leg lifting actuators comprises a driving shaft and a motor member engaged with the driving shaft for driving the driving shaft to rotate, wherein the driving shaft of the back lifting actuator is engaged with the back lifting arm for operably adjusting the back lifting arm at desired back positions, and wherein the driving shaft of the leg lifting actuator is engaged to the leg lifting mechanism for operably adjusting the leg lifting mechanism at desired leg positions.

2. The adjustable bed of claim 1, wherein the leg lifting mechanism comprises first, second, and third leg supporting members, wherein the first leg supporting member is connected to the driving shaft of the leg lifting actuator, the second leg supporting member is pivotally connected to the first leg supporting member, the third leg supporting member is pivotally connected to the second leg supporting member and the frame structure.

3. The adjustable bed of claim 1, wherein the plurality of platforms comprises at least one back platform, a thigh platform and a leg platform coupled to the lifting mechanism, such that the at least one back platform is operably rotatable around its lower edge in a back platform downward rotating direction or a back platform upward rotating direction; and the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

4. The adjustable bed of claim 1, further comprising one or more massage devices installed on the plurality of platforms for operably providing massage effects.

5. The adjustable bed of claim 4, wherein the one or more massage devices comprise sonic vibrators, and/or motor driven massagers.

6. The adjustable bed of claim 1, further comprising one or more breathing members installed on the plurality of platforms.

7. The adjustable bed of claim 1, wherein the upper rail and the lower rail are longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length that is adjustable or fixed and defines a size of the adjustable bed.

8. An adjustable bed, comprising:

a headboard assembly having a headboard and an upper rail attached to the headboard; a footboard assembly having a footboard and a lower rail attached to the footboard; a pair of sideboard assemblies having a pair of sideboards and a pair of side rails respectively attached to the pair of sideboards, wherein the pair of sideboard assemblies is transversely spaced and longitudinally aligned in parallel, and detachably attached to the headboard assembly and the footboard assembly; and a lifting mechanism attached to the side rails of the pair of sideboard assemblies for operably adjusting the adjustable bed at a desired position, wherein each lifting assembly comprises:

a bracket attached to a respective side rail of the pair of side rails, wherein the bracket comprises a base member attached to a respective one of the pair of side rails, a pair of tab members vertically attached to the base member, and a pair of bars transversely attached to top portions of the pair of tab members:

a back lifting arm and a leg lifting mechanism; and a back lifting actuator and a leg lifting actuator received in the bracket, wherein each of the back and leg lifting actuators comprises a driving shaft and a motor member engaged with the driving shaft for driving the driving shaft to rotate, wherein the driving shaft of the back lifting actuator is engaged with the back lifting arm for operably adjusting the back lifting arm at desired back positions, and wherein the driving shaft of the leg lifting actuator is engaged to the leg lifting mechanism for operably adjusting the leg lifting mechanism at desired leg positions.

9. The adjustable bed of claim 8, wherein the leg lifting mechanism comprises first, second, and third leg supporting members, wherein the first leg supporting member is connected to the driving shaft of the leg lifting actuator, the second leg supporting member is pivotally connected to the first leg supporting member, the third leg supporting member is pivotally connected to the second leg supporting member and the respective side rail.

10. The adjustable bed of claim 8, further comprising a plurality of platforms having at least one back platform, a thigh platform and a leg platform coupled to the lifting mechanism, such that the at least one back platform is operably rotatable around its lower edge in a back platform downward rotating direction or a back platform upward rotating direction; and the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

11. The adjustable bed of claim 10, further comprising one or more massage devices installed on the plurality of platforms for operably providing massage effects.

12. The adjustable bed of claim 10, further comprising one or more breathing members installed on the plurality of platforms.

13. An adjustable bed, comprising:

a frame structure having an upper rail, a lower rail, and a pair of side rails attached to the upper rail and the lower rail;

a pair of lifting assemblies, each lifting assembly comprising:

a bracket comprising a base member attached to a respective one of the pair of side rails, a pair of tab members vertically attached to the base member, and a pair of bars transversely attached to top portions of the pair of tab members;

a back lifting arm and a leg lifting mechanism; and a back lifting actuator and a leg lifting actuator engaged with the back lifting arm and the leg lifting mechanism, respectively, and received in the bracket; and a plurality of platforms disposed on the pair of lifting assemblies and the frame structure, such that in operation, the pair of lifting assemblies adjusts positions of at least one of the plurality of platforms so as to adjust the adjustable bed at a desired position.

* * * * *